US012116174B2

(12) United States Patent
Ruthe-Steinsiek et al.

(10) Patent No.: US 12,116,174 B2
(45) Date of Patent: Oct. 15, 2024

(54) ASSEMBLY COMPRISING A CONTAINER AND A CAP

(71) Applicant: Henkel AG & Co. KGaA, Duesseldorf (DE)

(72) Inventors: Kai Ruthe-Steinsiek, Duesseldorf (DE); Peter Rushe, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 646 days.

(21) Appl. No.: 17/155,839

(22) Filed: Jan. 22, 2021

(65) Prior Publication Data

US 2021/0139202 A1 May 13, 2021

Related U.S. Application Data

(63) Continuation of application No. PCT/EP2019/069544, filed on Jul. 19, 2019.

(30) Foreign Application Priority Data

Jul. 26, 2018 (DE) ..... 102018212470.1

(51) Int. Cl.
*B65D 41/04* (2006.01)
*B65D 47/18* (2006.01)

(52) U.S. Cl.
CPC ..... *B65D 41/0471* (2013.01); *B65D 47/18* (2013.01); *B65D 2251/01* (2013.01); *B65D 2251/04* (2013.01); *B65D 2251/065* (2013.01)

(58) Field of Classification Search
CPC ..... B65D 41/0471; B65D 47/18; B65D 2251/01; B65D 2251/04; B65D 2251/065; B65D 2251/0015; B65D 2251/0078
(Continued)

(56) References Cited

U.S. PATENT DOCUMENTS 3,581,926 A * 6/1971 Roder ..... B65D 41/0471 D9/435
3,756,732 A * 9/1973 Stoffler ..... B65D 47/42 401/262

(Continued)

FOREIGN PATENT DOCUMENTS

DE 102016222682 B3 10/2017
EP 0696993 B1 6/2002

(Continued)

OTHER PUBLICATIONS

International Search Report for International PCT Patent Application No. PCT/EP2019/069544 dated Nov. 4, 2019.

*Primary Examiner* — James N Smalley
(74) *Attorney, Agent, or Firm* — Mary K. Cameron

(57) ABSTRACT

An assembly consisting of a container (1) having a nozzle (17) for dispensing a substance contained in the container (1), and a cap (19) for covering the nozzle (17), the container having a first connection region (14) which can be connected to a corresponding second connection region (25) of the cap (19), the connection regions (14, 25) being selected such that the container (1) and the cap (19) are connected at least partially by a rotational movement of the container (1) and the cap (19) relative to one another, the cap (19) having an inner chamber (20) surrounded by a casing (22), which chamber is open at one end so as to receive the nozzle (17), the casing (22) having an end face (21) at its open end, and the container (1) having a cover face (12) which points toward the cap and has a cover edge (11), the connection regions (14, 25) being selected and the end face (21) being adapted to the cover face (12) and the cover edge (11) thereof such that, when the container (1) and the cap (19) are connected, the end face (21) comes into contact with the cover face (12) when the cap (19) is in a first intermediate position and, when the container (1) and the cap (19) are (Continued)

rotated further relative to one another, the end face (21) is pressed against the cover face (12) and the cap (19) ultimately reaches a second end position, the end face (21) passing over the cover edge (11).

12 Claims, 6 Drawing Sheets

(58) Field of Classification Search
USPC ..... 222/519–521, 548, 568; 215/395; 220/740
See application file for complete search history.

(56) References Cited

U.S. PATENT DOCUMENTS 3,888,373 A * 6/1975 Gach ..... B65D 50/046 215/214
4,230,232 A 10/1980 Atkins
4,266,682 A * 5/1981 Speitel ..... B65D 41/0478 215/334
4,310,101 A * 1/1982 Sekine ..... B65D 41/0478 215/331
5,634,496 A * 6/1997 Grabner, Jr. ..... B65D 41/0485 138/89.1
5,715,960 A * 2/1998 Seymour ..... B65D 41/17 215/318
5,992,656 A * 11/1999 Dujardin ..... B29D 23/20 215/331
7,758,553 B2 * 7/2010 Poisson ..... A61M 35/003 222/215
7,959,022 B2 * 6/2011 Kerman ..... B65D 41/0471 215/43
8,079,483 B2 * 12/2011 Brozell ..... B65D 41/0471 215/217
2009/0224008 A1 * 9/2009 Rushe ..... B65D 47/122 222/562
2018/0029069 A1 * 2/2018 Wolf ..... B05C 17/10
2020/0055643 A1 2/2020 Baumann

FOREIGN PATENT DOCUMENTS

EP 1091884 B1 1/2003
EP 1304296 A2 4/2003
JP 2007302253 A 11/2007

* cited by examiner

ASSEMBLY COMPRISING A CONTAINER AND A CAP

FIELD

The present invention relates to an assembly comprising a container having a nozzle for dispensing the substance contained in the container, and a cap for covering the nozzle. Assemblies of this kind can be used in particular to dispense an adhesive and/or a sealant.

BRIEF DESCRIPTION OF RELATED TECHNOLOGY

Assemblies of the type described at the outset are well known. The cap is sometimes used to prevent the substance contained in the container from drying out or to prevent contamination of the nozzle.

For example, EP0696993B1 discloses an assembly comprising a container having a nozzle for dispensing an adhesive located in the container, and a cap for covering the nozzle. The cap can be brought into engagement with a protruding locking element and can be connected to the container by means of a rotational movement.

Another example of an assembly of this kind is found in EP1091884B1, in which a connecting means comprising a threaded region is used to connect the cap to the container.

SUMMARY

The object of the invention is to provide an improved assembly which in particular makes it easier for the user to handle the assembly.

This object is achieved by means of the features of claim 1.

Advantageous developments of the present invention are specified in the dependent claims.

The basic concept of the present invention is that of providing an assembly consisting of a container having a nozzle for dispensing the substance contained in the container, and a cap for covering the nozzle, the container having a first connection region which can be connected to a corresponding second connection region of the cap, the connection regions being selected such that the container and the cap are connected by means of the connection regions at least partially by a rotational movement of the container and the cap relative to one another, the cap having an inner chamber surrounded by a casing, which chamber is open at one end so as to receive the nozzle, the casing having an end face at its open end, and the container having a cover face which points toward the cap and has a cover edge, the connection regions being selected and the end face being adapted to the cover face and the cover edge thereof such that, when the container and the cap are connected, the end face comes into contact with the cover face when the cap is in a first intermediate position and, when the container and the cap are rotated further relative to one another, the end face is pressed against the cover face and the cap ultimately reaches a second end position, the end face passing over the cover edge.

An assembly of this kind is advantageous in that it makes it possible for the user to know when the assembly is in the closed state. When the cap is in its first intermediate position, the end face comes into contact with the cover face of the container and, when rotated further, passes over the cover edge of the container in order to reach its end position. As a result of the end face passing over the cover edge, ideally with a snap or catch action, the user receives audible and/or tactile feedback, for example in the form of a click sound, that the cap has reached the end position and that the nozzle is now securely closed by the cap. The cap and/or the container can be made, at least in regions, of a resilient material, which is put under tension when the end face is pressed against the cover face and the tension of which is released when the cap reaches and passes over the cover edge such that the result described above is achieved. The cap and/or the container are preferably made of a plastics material. For example, the cap and/or the container can be made of a polymer material, such as a polyethylene (PE) or also a polypropylene (PP). In a preferred embodiment, the bottle and the nozzle are made of high density polyethylene (HDPE), and the cap is again made of polypropylene (PP).

At least one of the connection regions can be in the form of a thread or an at least thread-like region and have at least one pitch. A bayonet-like design is also conceivable. The cover face of the container can be flat and in the form of a flat plane, for example in the form of a container shoulder. Nevertheless, other shapes for the cover face are also conceivable. For example, the cover face can also be designed merely as the top face of a wall or a portion of the container, provided that only the top face can be brought into contact with the end face of the cap and that the cap can pass over the cover edge of the cover face when rotated further.

It is also advantageous to design the container such that a lower cover face pointing toward the cap is provided, which adjoins a step starting from the cover edge described above, the lower cover face being arranged such that the end face comes into contact with the lower cover face when the cap is in its second end position. A design of this kind provides for a particularly tight assembly, for example, since the inner chamber is particularly easy to seal. The height of the step is particularly preferably in a range of from 0.1 mm to 1 mm, particularly preferably in a range of from 0.3 mm to 0.5 mm. In a particularly advantageous embodiment, the step can have a height of 0.4 mm.

It is also advantageous to arrange a securing means on the cap and/or on the container in order to secure the cap on the container in the second end position. This securing means can be designed, for example, as a protruding lug on one component of the assembly, which lug engages in a corresponding recess in the corresponding other component. It is conceivable for the lug to extend in the direction of the nozzle, i.e. forward. Of course, the lug can also extend laterally away from the nozzle. With an assembly of this kind, the user can be provided with a container which can be securely and visibly closed, and which he can assume to remain closed.

In an advantageous development, the container has a stop in order to prevent the container and the cap from rotating relative to one another beyond the second end position. This stop can be designed, for example, as a protruding stop element on the connection region on one component of the assembly, against which element the corresponding other component strikes. Of course, it is also conceivable for the two components, i.e. the cap and the container, to have corresponding stops in order to provide for particularly effective limitation of the rotational movement. Overturning can be prevented by using a stop, such that in particular the connection regions are not damaged in the event of incorrect operation by the user.

It is also advantageous to design the cover face such that it consists of two halves which extend outward on two opposite sides of the nozzle, the angle between an axis of the nozzle and the relevant half of the cover face being greater than 90°. In a side view, the two halves would be arranged in a V shape, the apex pointing toward an application opening in the nozzle. With a design of this kind, the substance contained in the container can be dispensed in a particularly simple manner, since, in the described shape, the nozzle protrudes from the halves of the cover face that slope laterally downward. In an advantageous development, the two halves are flat. In an advantageous development, the cap has a corresponding design such that the casing of the cap is designed such that the end face consists of two halves which extend obliquely outward according to the described shape of the cover face. Ideally, the container and the cap are designed such that the end face extends in parallel with the adjacent cover face of the container in the second end position. A design of this kind can also simplify the feedback for the user and reduce the resistance of the cap to pass over the cover edge of the container.

Alternatively, instead of a flat design of the halves of the cover faces, it is of course also conceivable for the cover faces to be rounded on both sides of the nozzle. In this case, the end face of the cap would preferably have a corresponding design.

In an advantageous development, the cover edge is in two planes which extend outward on two opposite sides of the nozzle, the angle between the axis of the nozzle and the respective planes of the cover edge being greater than 90°. In a side view, the two halves would also be arranged in a V shape, the apex pointing toward an application opening in the nozzle. Ideally, this advantageous embodiment is combined with the variant described above in which the cover face also consists of two halves which extend outward on two opposite sides of the nozzle, the angle between an axis of the nozzle and the relevant half of the cover face being greater than 90°. In an advantageous development, the cap has a corresponding design such that the casing is designed such that the end face consists of two halves which extend obliquely outward according to the described shape of the cover edge. Ideally, the container and the cap are designed such that the end face extends in parallel with the adjacent cover edge of the container in the second end position. This design can also simplify the feedback for the user and reduce the resistance of the cap to pass over the cover edge of the container.

It is also advantageous to use a container comprising an outer wall, the outer wall of the container and the casing of the cap being selected and matched to one another such that they are aligned with one another when the cap is in its second end position. With a solution of this kind, better handling of the assembly can be made possible because, for example, protruding edges in the transition region between the cap and the container can be avoided.

It is also advantageous to provide an attachment, which contains in particular the nozzle, the cover face and the cover edge, and which can be connected to the container by connecting means in order to form one of the two components of the assembly, which component now consists of a container together with the attachment. In this way, it can be ensured that a complex object is produced in a simple manner.

In an advantageous development, the nozzle has an application opening and the cap has a pin or a pin-shaped element which is suitable and designed for closing the application opening, the pin or the pin-shaped element being arranged at least in regions in the application opening when the cap is in its second end position, in order to close said opening. In this way, the substance in the container can be prevented from drying out, for example. It can also be ensured that no foreign objects get into the application opening.

It is also advantageous to provide a described assembly in which the container contains an adhesive and/or sealant which can be dispensed via the nozzle, and consequently to use the assembly for dispensing an adhesive and/or sealant contained in the container.

BRIEF DESCRIPTION OF THE DRAWINGS

The assembly according to the invention is described in detail on the basis of an embodiment. In the drawings.

DETAILED DESCRIPTION

Figure 1:
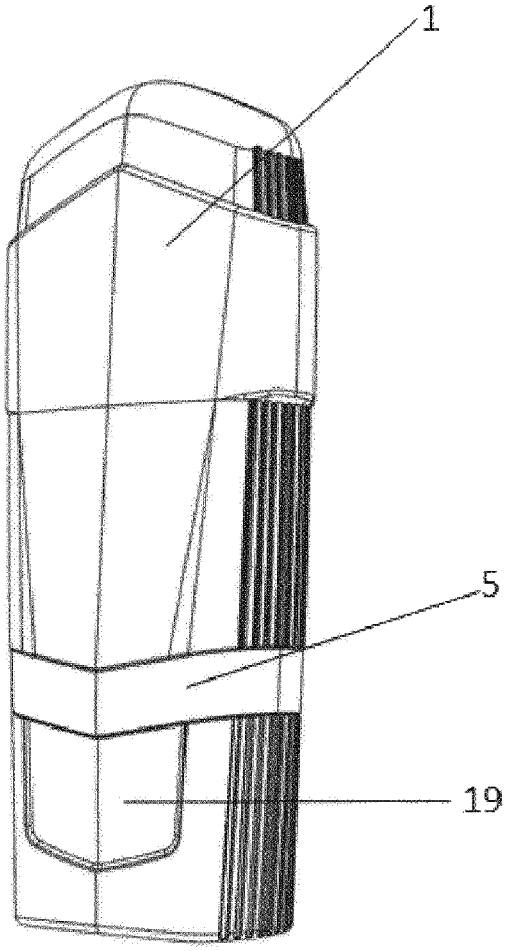
FIG. 1 is a perspective view of an assembly with the cap in its second end position.

FIG. 1 is a perspective view of an assembly according to the invention, comprising a container 1 containing a flowable adhesive composition in the form of a silane-crosslinking polymer, and a cap 19 which is connected to the container 1. Both components are made of a plastics material. When the cap 19 is in the second end position shown, the cap covers a nozzle (not shown), which is used to dispense the adhesive composition. The nozzle is part of an attachment 5, which is part of the container 1 or, as in the present case, is at least rigidly connected to the container 1.

Figure 2:
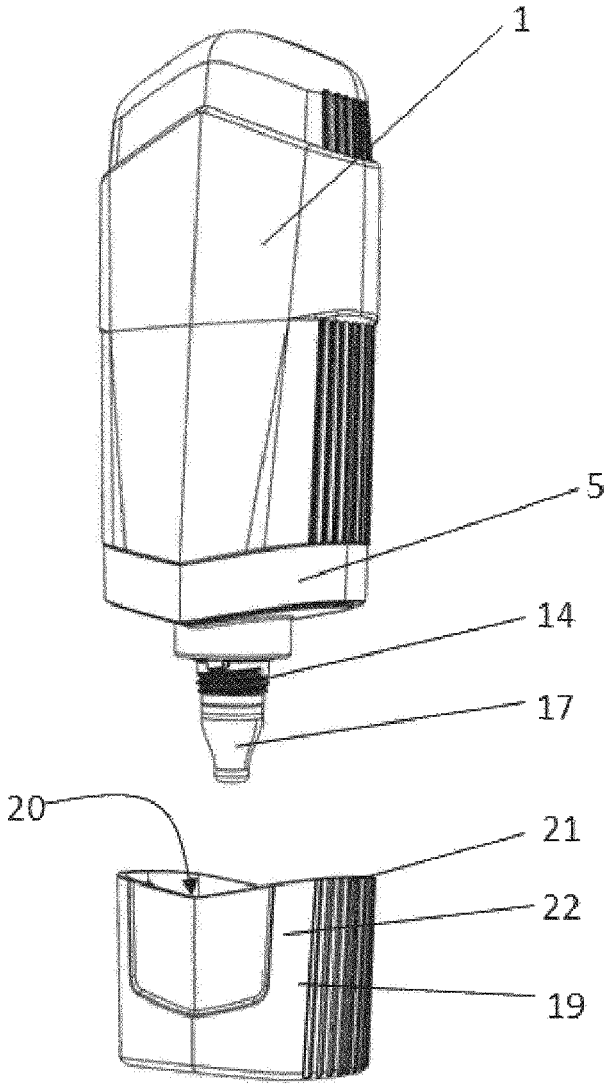
FIG. 2 is a perspective view of the assembly from FIG. 1 with the cap removed.

The cap 19 can be separated from the container 1 in order to dispense the adhesive composition. This is shown in FIG. 2. The now exposed nozzle 17 protrudes centrally from the attachment 5 in the distal direction. For installing the cap 19, the nozzle has an external thread 14, which can be brought into engagement with a corresponding connecting means of the cap 19 such that the container 1 and the cap 19 can be connected by a rotational movement of the two components relative to one another. The cap 19 has a casing 22 that surrounds an inner chamber 20, which is open at one end so as to receive the nozzle 17, the casing 22 having an end face 21 at its open end. The attachment 5 has a rafter-like design, the tip of said attachment pointing in the distal direction, and the nozzle 7 being arranged at the level of the tip of said attachment. In turn, the cap 19 has a shape on its casing 22 and on its end face 21 that corresponds to the rafter-like design of the attachment 5.

Figure 3:
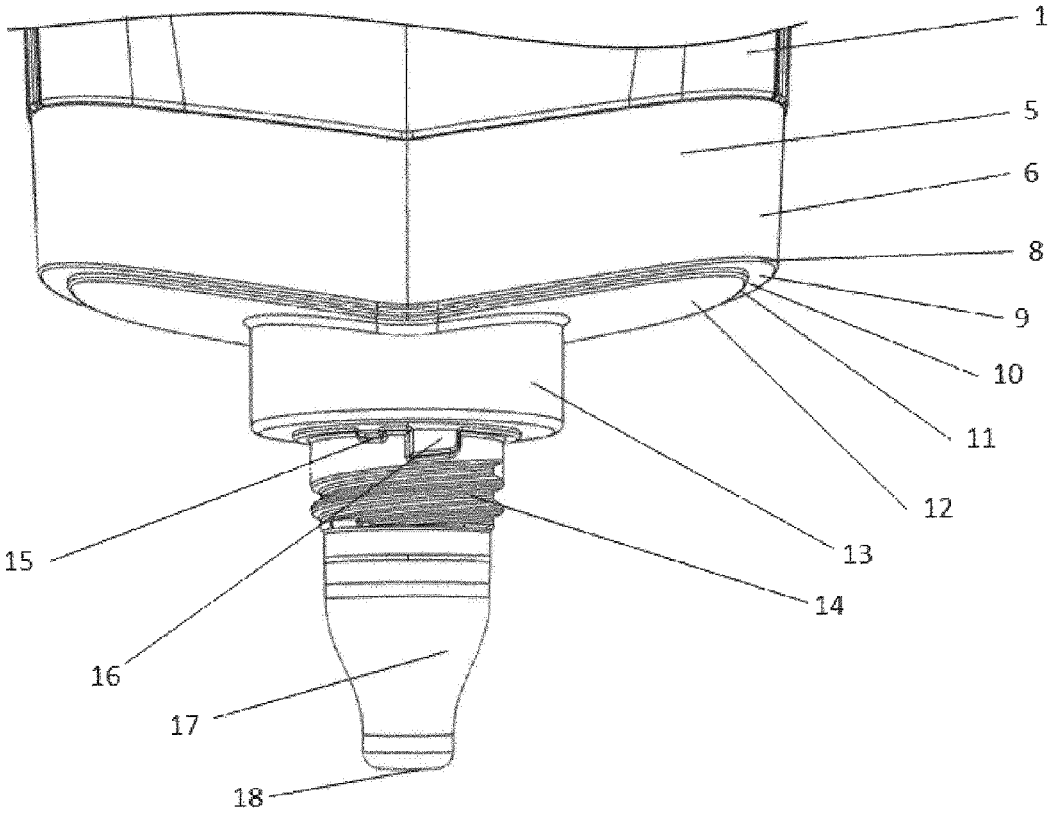
FIG. 3 is a front view of a detail of the assembly from FIG. 2.

FIG. 3 is a front view of a detail of the assembly from FIG. 2. In this figure, the attachment 5 of the container 1 is shown again with all its elements. Attachment 5 has an outer wall 6 which is aligned with the outer wall of the container 1 so that the user can handle the assembly as easily as possible. The outer wall 6 leads into a plateau in the form of a cover face 12, from the center of which a cylindrical extension 13 extends in the distal direction, to which extension the nozzle 17 having an application opening 18 is attached. In the region nearer the extension 13, the nozzle 17 has said external thread 14 and a protruding locking element 15. Furthermore, a stop 16 is provided, which is used to limit the rotational movement of the cap (not shown). The transition region between the outer wall 6 and the cover face 12 is stepped in that the outer wall 6 is delimited by a lower cover edge 8 to which a lower cover face 9 is attached substantially at right angles from the outer wall 6. The lower cover face 9 is in the form of a narrow, plateau-shaped ring that extends around the nozzle. A further cover edge 11 adjoins a step 10, which further cover edge 11 forms the transition to said cover face 12. The step 10 has a height of 0.4 mm. Due to the rafter-like design of the attachment 5 described above, the cover face 12 consists of two halves which extend outward on two opposite sides of the nozzle 17, the angle between an axis of the nozzle 17 and the relevant half of the cover face 12 being greater than 90°. The same applies to the cover edge 11, which also follows the rafter-like design of the attachment 5 and is therefore in two planes which extend outward on two opposite sides of the nozzle 17, the angle between the axis of the nozzle 17 and the relevant plane of the cover edge 11 being greater than 90°.

Figure 4:
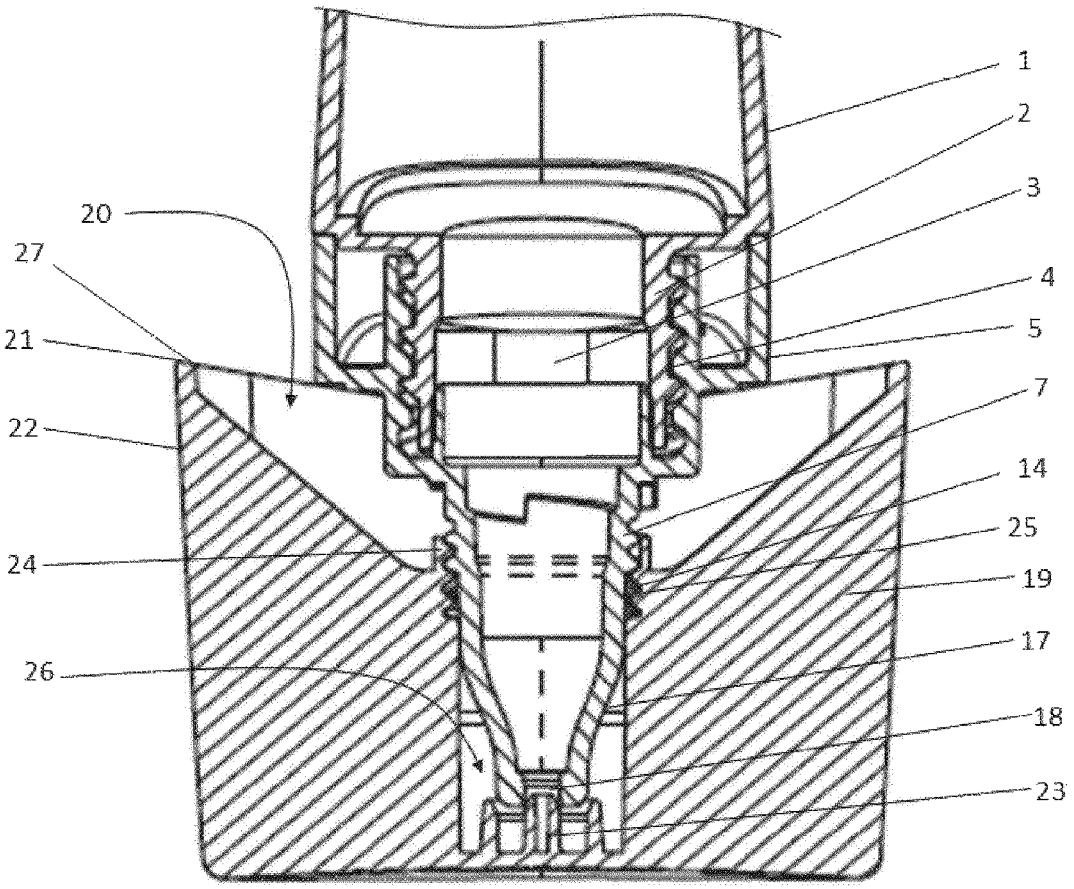
FIG. 4 is a sectional side view of the assembly from FIG. 1 while the cap is being fitted.

FIG. 4 is a sectional side view of the assembly from FIG. 1 while the cap 19 is being fitted, which cap can also be seen in a sectional view. The inner chamber 20 can be seen in this figure, which chamber is enclosed by the casing 22. In the proximal direction, the casing 22 leads into the end face 21 by an inner end edge 27. An installation region 24 is provided in the inner chamber 20, which region is in the form of a sleeve having an internal thread 25, which has already been partially brought into engagement with the external thread 7 of the nozzle 17 in the embodiment shown. In the distal direction, a receiving chamber 26 provided for the front region of the nozzle 17 adjoins the installation region 24. At the end face, the receiving chamber 26 is equipped with a protruding pin 23, which engages in the application opening 18 and tightly seals said opening when the cap 19 is fitted on the container 1. In the drawing shown, it can also be seen that the attachment 5 is rigidly and captively connected to the container 1 by means of suitable connecting means 4; in the embodiment shown, the attachment 5 has been attached to the container with a snap-on action, and can thus be considered part of the container 1. The part of the connecting means 4 that is on the container side is arranged on a protruding dispensing extension 2, in which there is a dispensing channel 3 for the adhesive composition located in the container 1.

Figure 5:
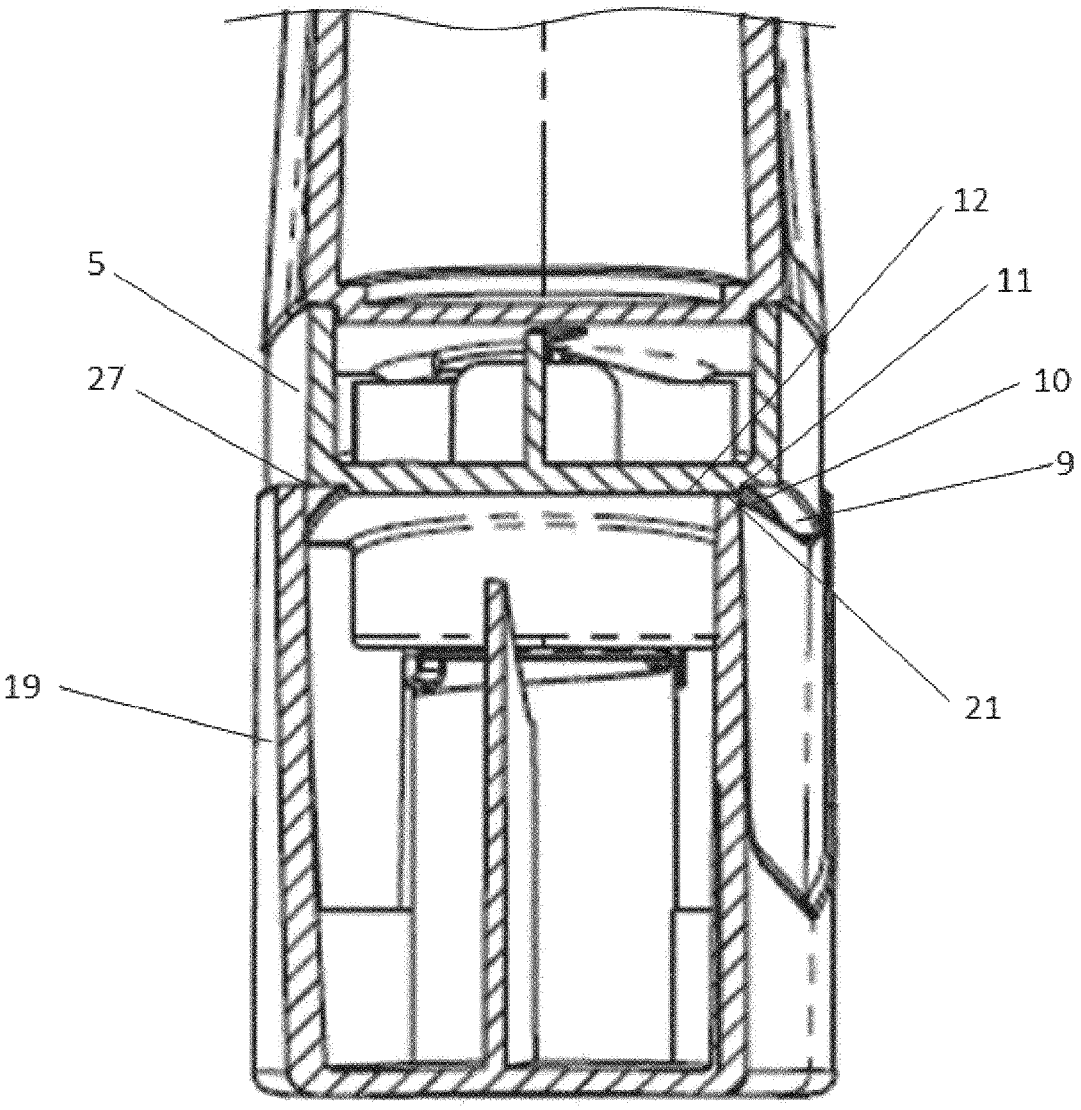
FIG. 5 is a sectional side view of the assembly from FIG. 1 with the cap in its first intermediate position.
Figure 6:
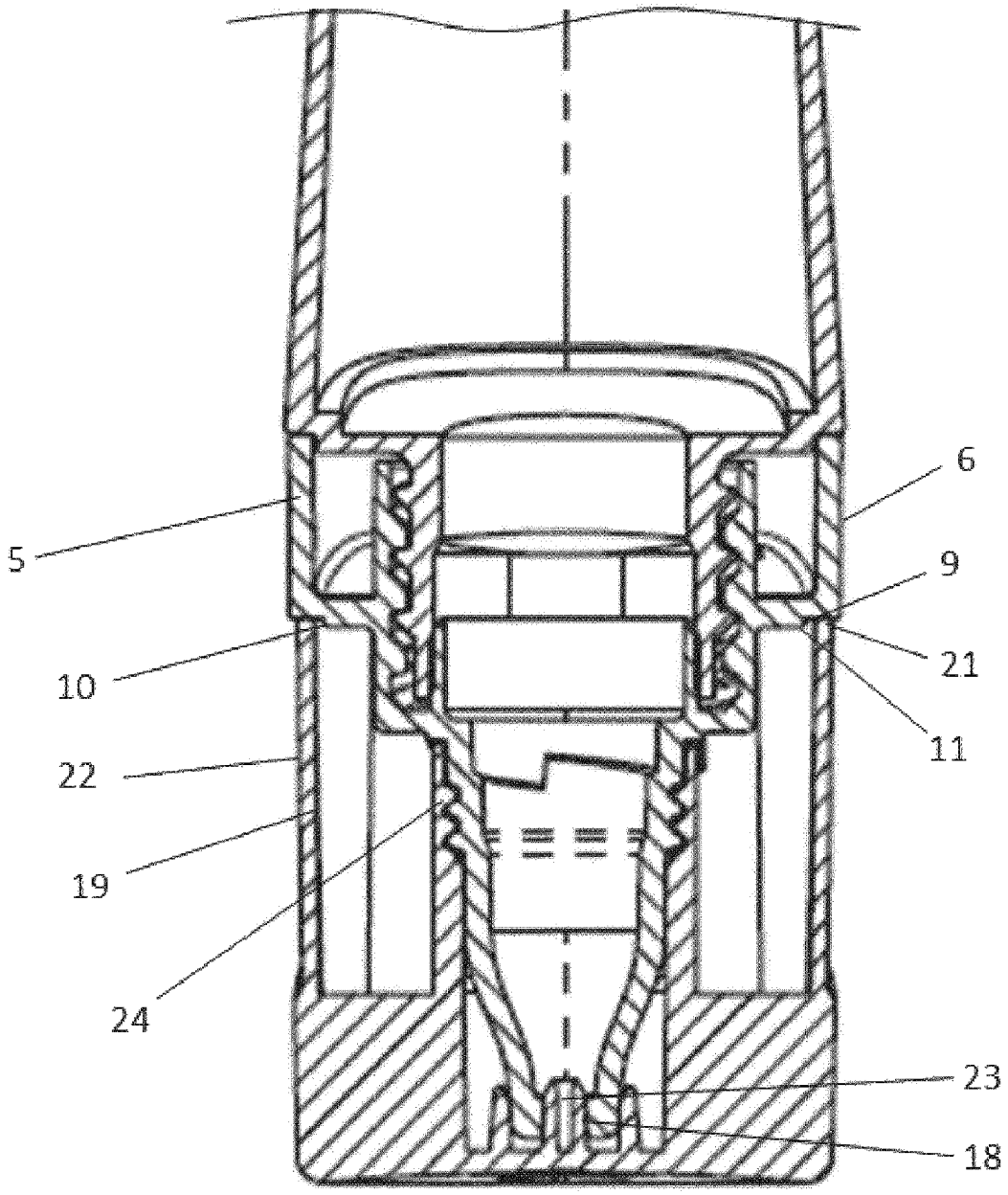
FIG. 6 is a sectional side view of the assembly from FIG. 1 with the cap in its second end position.

By turning the cap 19 further relative to the container 1, the cap 19 finally reaches its first intermediate position shown in FIG. 5. The distance between the cap 19 and the container 1 has been reduced further by the rotation, and therefore the end face 21 is now in contact with the opposite cover face 12 of the attachment 5. Further rotation of the cap 19 relative to the container 1 puts the cap under tension due to the plastics material used. When the container 1 and the cap 19 are rotated further relative to one another, the cap 19 finally reaches the second end position shown in FIG. 6, with the end face 21 passing over the cover edge 11 and the tension on the cap 19 pre-tensioned as described above being released when said cap reaches and passes over the cover edge 11. The cap passes over the cover edge with a catch action, and this provides the user with an audible and/or tactile click such that they know that the cap 19 has reached the end position and that no further rotation is required. In the second end position shown in FIG. 6, the end face 21 of the cap 19 lies against the lower cover face 19 so as to allow for a tight seal between the cap 19 and the attachment 5 and thus the container 1. Furthermore, in the state shown, the casing 22 of the cap 19, the outer wall 6 of the attachment 5 and the outer wall of the container 1 are aligned with one another in order to provide the user with an assembly which is easy to handle.

The protruding locking element 15 shown in FIG. 3 is used as a securing means and, in the second end position shown, engages in a corresponding recess in the installation region 24 of the cap 19 in order to secure the cap 19 to the container 1 in the second end position. In addition, the installation region 24 has a stop portion that corresponds to the stop 16, also shown in FIG. 3, in order to prevent the container 1 and the cap 19 from rotating relative to one another beyond the second end position.

LIST OF REFERENCE NUMERALS

1 container
2 dispensing extension
3 dispensing channel
4 connecting means
5 attachment
6 outer wall
7 external thread
8 lower cover edge
9 lower cover face
10 step
11 cover edge
12 cover face
13 extension
14 external thread
15 locking element
16 stop
17 nozzle
18 application opening
19 cap
20 inner chamber
21 end face
22 casing
23 pin
24 installation region
25 internal thread
26 receiving chamber
27 inner front edge

The invention claimed is:

1. An assembly consisting of:

a container having a nozzle for dispensing a substance contained in the container, and a cap for covering the nozzle, the container having a first connection region which can be connected to a corresponding second connection region of the cap, the connection regions being selected such that the container and the cap are connected at least partially by a rotational movement of the container and the cap relative to one another, the cap having an inner chamber surrounded by a casing, which chamber is open at one end so as to receive the nozzle, the casing having an end face at its open end, and the container having a cover face which points toward the cap and has a cover edge, wherein the connection regions are selected and the end face is adapted to the cover face and the cover edge thereof such that when the container and the cap are connected, the end face comes into contact with the cover face when the cap is in a first intermediate position and, when the container and the cap are rotated further relative to one another, the end face is pressed against the cover face and the cap ultimately reaches a second end position, the end face passing over the cover edge and wherein the container has a radially outwardly extending stop that abuts an installation region provided in the cap inner chamber in the second position to prevent the container and cap from rotating relative to one another beyond the second position, wherein the container has a cylindrical extension connecting the cover face to the nozzle and the stop extends distally from the extension and radially outwardly from the nozzle.

2. The assembly according to claim 1, wherein the container has a lower cover face pointing toward the cap, which adjoins a step starting from the cover edge, the lower cover face being arranged such that the end face comes into contact with the lower cover face when the cap is in its second end position.

3. The assembly according to claim 1, wherein the cover face consists of two halves which extend outward on two opposite sides of the nozzle, the angle between an axis of the nozzle and the half of the cover face being greater than 90°.

4. The assembly according to claim 1, wherein the cover edge is in two planes which extend outward on two opposite sides of the nozzle, the angle between the axis of the nozzle and the relevant plane of the cover edge being greater than 90°.

5. The assembly according to claim 1, wherein the container has an outer wall, the outer wall and the casing of the cap being selected such that they are aligned with one another when the cap is in its second end position.

6. The assembly according to claim 1, wherein the nozzle, the cover face and the cover edge are provided on an attachment, and the attachment is connected to the container.

7. The assembly according to claim 1, wherein the nozzle has an application opening and the cap has a pin for closing the application opening, the pin being arranged in the application opening when the cap is in its second end position to close said opening.

8. The assembly according to claim 1, wherein the container contains an adhesive and/or sealant which can be dispensed via the nozzle.

9. An assembly for dispensing an adhesive or sealant; comprising:

a container having a closed end and a distally separated attachment, the attachment fluidly connected to the container and comprising a cover face including a cover edge, the attachment is fluidly connected to a distally extending extension which is fluidly connected to a distally extending nozzle, the attachment including an externally threaded connection region;

a cap comprising an inner chamber surrounded by a casing, the chamber is open at one end so as to receive the nozzle and defines an internally threaded connection region, the casing having an end face at its open end, the connection regions being selected such that the container and the cap are connected at least partially by a rotational movement of the container and the cap relative to one another;

wherein the casing end face is adapted to the attachment cover face and the cover edge thereof such that when the container and the cap are connected, the end face comes into contact with the cover face when the cap is in a first intermediate position and, when the container and the cap are rotated further relative to one another, the end face is pressed against the cover face and the cap ultimately reaches a second end position, the end face passing over the cover edge.

10. The assembly of claim 9 wherein the container has a radially outwardly extending stop that abuts an installation region provided in the cap inner chamber in the second position to prevent the container and cap from rotating relative to one another beyond the second position.

11. The assembly of claim 9 wherein the attachment is oblong, the extension has a smaller dimension than an attachment width, and the nozzle is round with a diameter smaller than the extension small dimension.

12. The assembly according to claim 9, wherein the cover edge is in two planes which extend outward on two opposite sides of the extension, the angle between the axis of the nozzle and the relevant plane of the cover edge being greater than 90°.

* * * * *